US006637493B1

(12) United States Patent
Lampers

(10) Patent No.: US 6,637,493 B1
(45) Date of Patent: Oct. 28, 2003

(54) DEVICE AND METHOD FOR HOLDING WINDOW COVERING PULL CORDS

(76) Inventor: Nicholas Lampers, 18039 Crystal River Dr., Macomb Township, MI (US) 48042

( * ) Notice: Subject to any disclaimer, the term of this patent is extended or adjusted under 35 U.S.C. 154(b) by 0 days.

(21) Appl. No.: 10/118,381

(22) Filed: Apr. 5, 2002

(51) Int. Cl.[7] ..... E06B 9/30

(52) U.S. Cl. ..... 160/178.1 R; 160/168.1 R; 160/173 R

(58) Field of Search ..... 160/168.1, 173 V, 160/173 R, 177 V, 177 R, 178.1 R, 178.2 R

(56) References Cited

U.S. PATENT DOCUMENTS 4,779,816 A * 10/1988 Varlet ..... 242/96
4,909,297 A * 3/1990 Koller et al. ..... 160/84.1
4,909,298 A * 3/1990 Langhart et al. ..... 160/178.1
5,439,390 A * 8/1995 Raynor et al. ..... 439/502
5,630,458 A * 5/1997 Holden ..... 160/178.1
5,735,329 A * 4/1998 Akins et al. ..... 160/178.1 R
6,453,974 B1 * 9/2002 Lai et al. ..... 160/168.1 R

* cited by examiner

*Primary Examiner*—Bruce A. Lev
(74) *Attorney, Agent, or Firm*—John R. Benefiel

(57) ABSTRACT

A holder device and method for stowing window covering pull cords to be out of reach of a small child involving the use of a first piece of hook and loop material secured at the end of the pull cords and a second matable piece of hook and loop material attached to the window frame so as to enable the pull cords to be looped and thus held at a higher level than that at which they would otherwise hang. A notch in the first piece allows a second loop to be draped therein allowing the stowed pull cords to be held even higher above the floor.

6 Claims, 3 Drawing Sheets

DEVICE AND METHOD FOR HOLDING WINDOW COVERING PULL CORDS

BACKGROUND OF THE INVENTION

This invention concerns safety devices for eliminating the strangulation hazard presented by the dangling pull cords for window coverings such as blinds, pleated shades, etc. Such pull cords are often connected at their lower ends to create a noose. Even single cords can cause strangling of an infant or small child if neck entanglement occurs.

Many devices and arrangements have been proposed to alleviate this hazard, as for example the device shown in U.S. Pat. No. 4,909,298, which allows for readily separable cord ends to allow an entrapped child to free himself (or herself), and also a way of looping the cords on an elevated support to be out of reach of the child.

Such devices have been relatively conspicuous and complicated.

It is desirable that such devices be inconspicuous so as to not compromise the aesthetics of the window covering and also to be low in cost.

It is the object of the present invention to provide a device for holding window covering pull cords which is unobtrusive and simple and can be manufactured at a very low cost.

SUMMARY OF THE INVENTION

The above recited object and others which will become apparent upon a reading of the following specification and claims are achieved by a two element holding device, the first element being a short narrow strip of hook and loop material (i.e., Velcro™) which has a notch on one end and a hole through which the pull cords are threaded and retained with the pull which is larger than the hole. The second element comprises a small patch of mating hook and loop material which is glued or otherwise attached to the window frame at a point high enough to hold the cords out of reach of a small child when the strip is detachably affixed to the patch. The cords are then able to be draped over the notched end to be held up well out of reach for small children.

The small size of the hook and loop material pieces makes them very lightweight and unobtrusive, and can be made at very low cost. Various colors of this material are available to further enhance the unobtrusiveness of the device.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
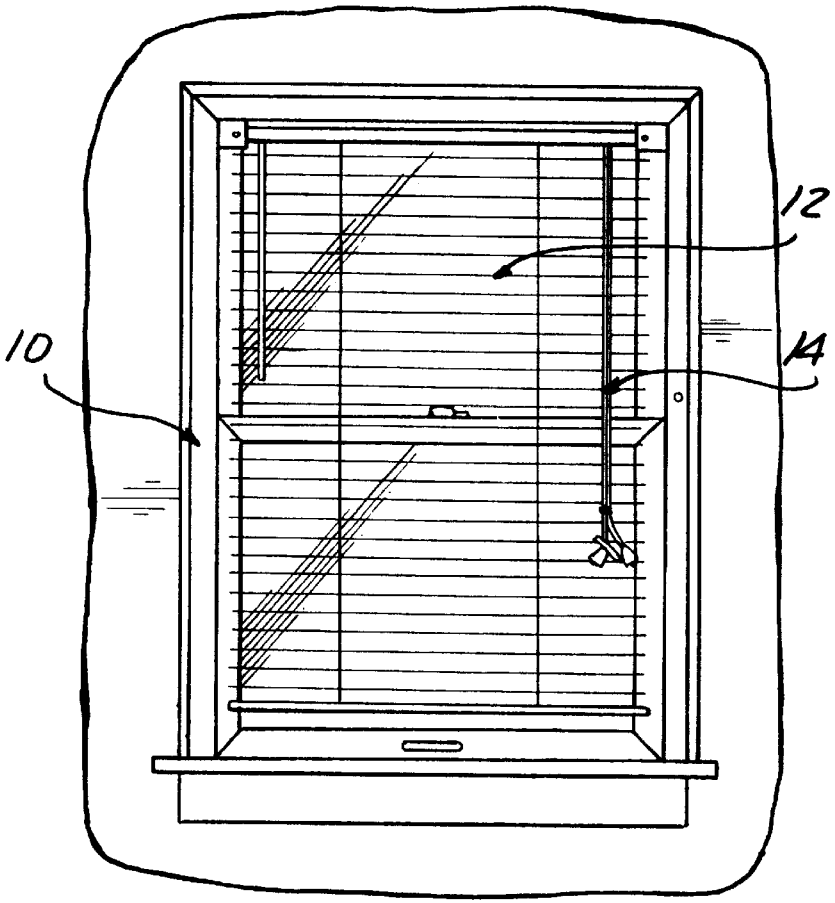
FIG. 1 is a front view of a window with a window covering having a pull cord holder device according to the invention installed.

FIG. 1 shows a window 10 having covering blinds 12 the level of which is controlled by double pull cords 14A and 14B.

Figure 2:
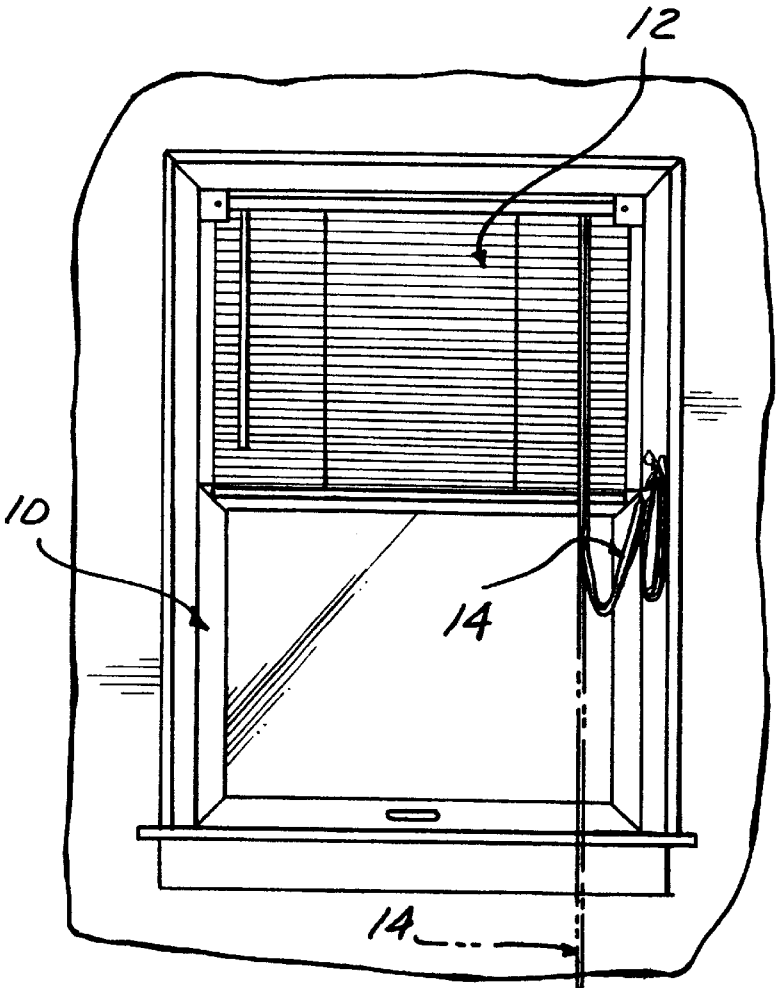
FIG. 2 is a front view of the window and covering shown in FIG. 1, with the covering partially elevated and double pull cords held well above the floor by the holder device according to the invention.

In FIG. 2, the blinds. 12 have been raised by pulling down the pull cords 14, which are thereby lengthened, as shown in phantom to be closer to the floor beneath the window.

The pull cords 14A, B are held in a looped and draped condition well above the floor by a holder device according to the invention.

Figure 3:
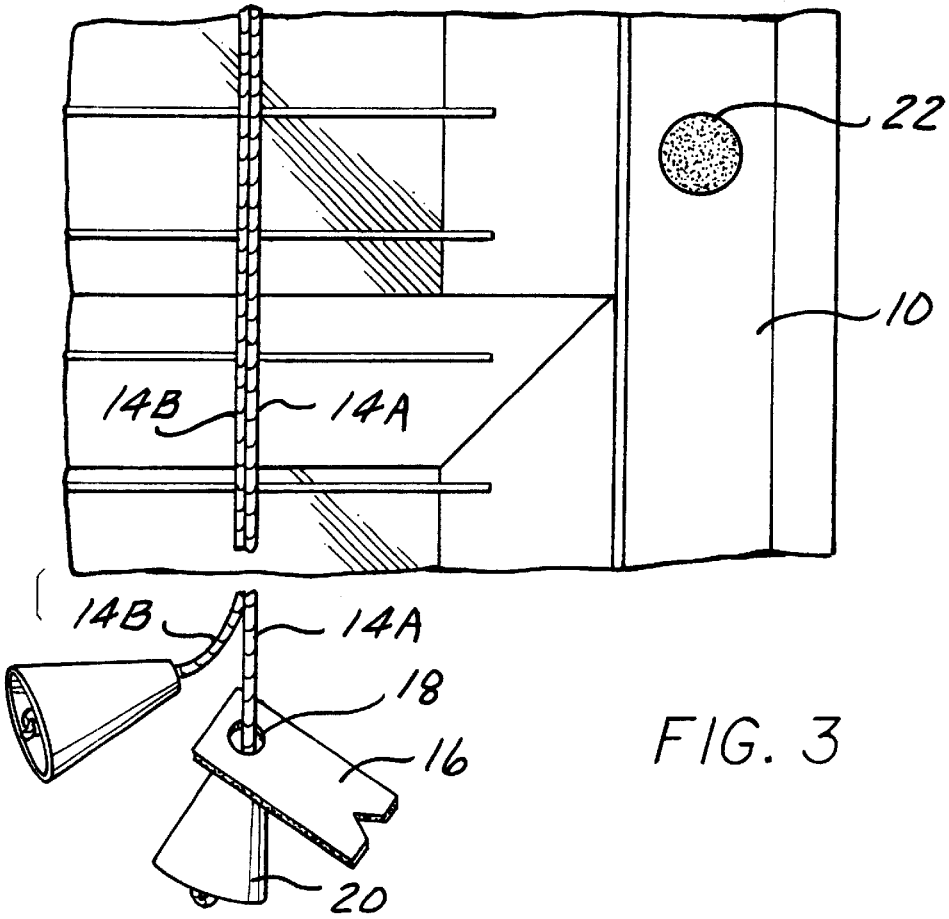
FIG. 3 is an enlarged fragmentary perspective view of a portion of the window covering showing the details of the pull cover holder device elements in a separated condition associated with double pull covers.
Figure 4:
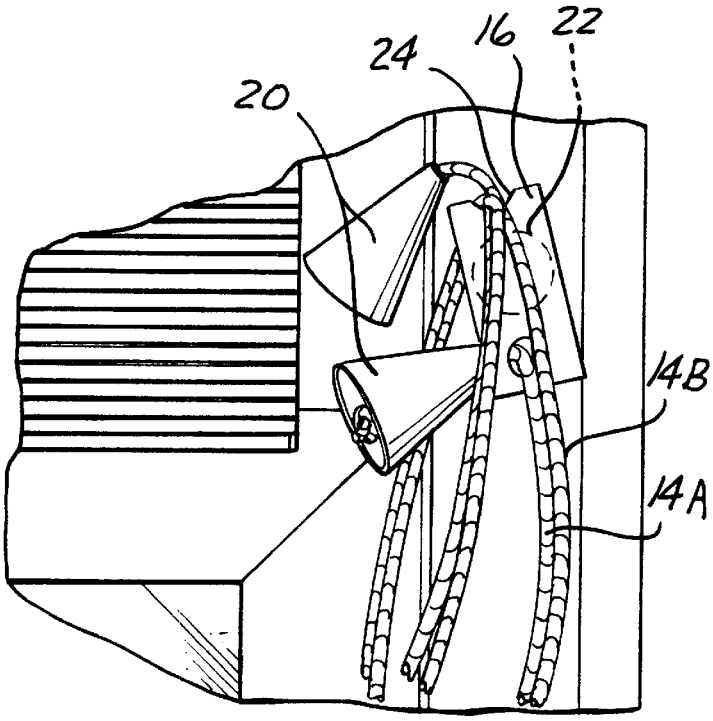
FIG. 4 is an enlarged fragmentary view of a portion of the window and covering showing the details of the pull cord holder device in the pull cord stowed position.

FIGS. 3 and 4 show the details of the pull holder device, which is comprised of two elements, the first being a short strip 16 of hook and loop material (preferably the loop material) having a hole 18 through which one of two pull cords 14A is threaded, the hole 18 being smaller than the pull 20 secured to the pull cord end to thereby be retained on the end of the one pull cord 14A. A notch 24 is cut into one end of the strip 16.

The second element of the holder device is a small patch 22 of a mating hook and loop material (preferably the hook material) glued or otherwise attached to the side frame of the window 10 at an elevated location above the floor, well out of the reach of small children.

The pull cords 14A, 14B are looped by first sticking the strip 16 to the patch 22. A second loop is formed by draping the pull cords 14A, 14B over the notch 24 as shown in FIG. 4 to form a second doubled loop. The cord 14B has its end also looped over the notch 24.

Thus, as seen in FIG. 2, the pull cords 14A, 14B are securely held up out of the reach of small children, yet are quickly and easily released to allow the covering to again be lowered.

The small size of the holder elements renders the device very unobtrusive. The simplicity of the device also allows it to be made at very low cost.

Figure 5:
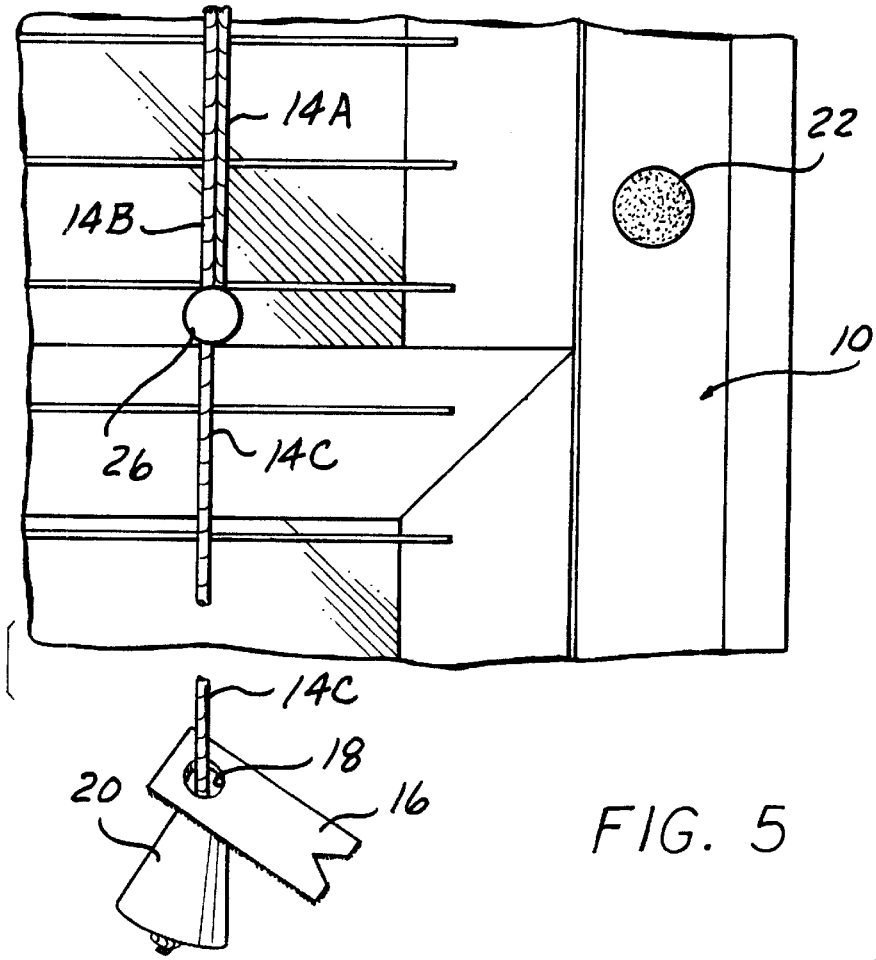
FIG. 5 is an enlarged fragmentary view of a portion of the window covering showing the holder device used with a single pull cord.
Figure 6:
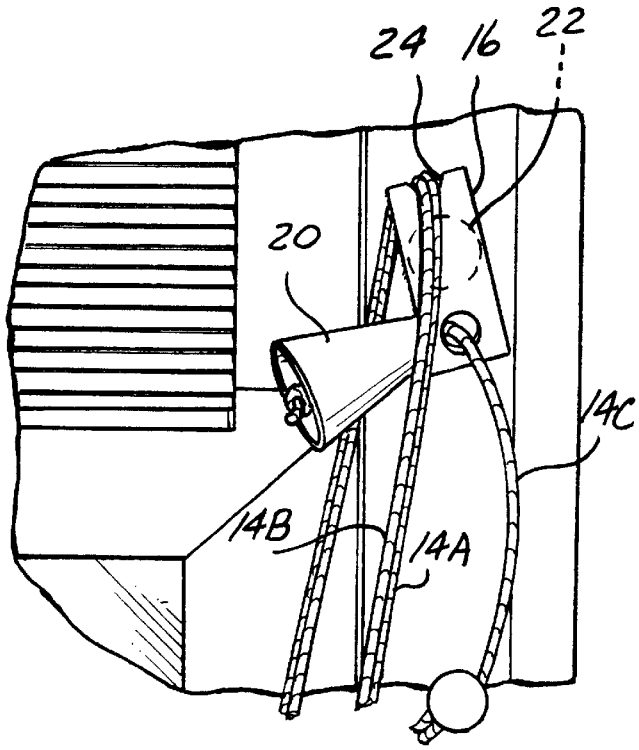
FIG. 6 shows the holder device and single cord in the stowed position.

FIGS. 5 and 6 show the holder device used with a cord arrangement in which both cords 14A, 14B are connected together with a ball 26 and a segment 14C is suspended below the ball 26.

The lower segment 14C has its end received through the hole 18 and the pull 20 installed to hold the strip 16 thereon.

In this case, only the upper segments 14A, 14B are draped through the notch 24 of the strip 16.

What is claimed is:

1. In combination, a pull cord, a covering operated by said pull cord, said covering mounted within a window frame, said pull cord having a cap attached at one end of said cord, comprising:

a first element comprising a piece of hook and loop material held on a free end of said pull cord by said cord passing through a hole in said first element and retained by said cap being of larger diameter than said hole; and, a second element comprising a matable patch of hook and loop material affixed to said frame of said window to allow said free end of said cord to be held at a level set to be out of reach of a small child by mating the hook and loop material of said first element and said second element.

2. The combination according to claim 1 wherein said first element comprises a strip of hook and loop material notched at one end which can receive a loop of said pull cord draped thereon to further raise said pull cord higher above an adjacent floor.

3. The combination according to claim 2 wherein second element is attached to a side of said window frame.

4. A method of stowing a pull cord of a window covering at a higher level above an adjacent floor than the level at which said cord would otherwise hang to thereby be out of reach of a small child, comprising the steps of attaching a first element consisting of a piece of hook and loop material to the end of said pull cord by threading said cord through a hole formed in said first element and attaching a cap larger than said hole to said end of said cord;

mounting a second matable piece of hook and loop material at a level which will raise the height above said floor at which said end of said pull cord will be held when said first and second elements are mated; and mating said first and second elements together to stow said pull cord with said end elevated.

5. The method according to claim 4 further including the step of notching an upper end of said first element and draping a loop of said cord in said notch to raise the lowest level of said pull cord.

6. The method according to claim 5 wherein in attaching said second matable piece, said second matable piece is attached to a side of a window frame which receives said covering.

* * * * *